US006883946B1

(12) United States Patent
Kolar

(10) Patent No.: US 6,883,946 B1
(45) Date of Patent: Apr. 26, 2005

(54) FILTERED LIGHT

(76) Inventor: Paul D. Kolar, 12 Tomahawk La., Warrenton, MO (US) 63383

( * ) Notice: Subject to any disclaimer, the term of this patent is extended or adjusted under 35 U.S.C. 154(b) by 0 days.

(21) Appl. No.: 10/445,448

(22) Filed: May 28, 2003

(51) Int. Cl.[7] ..... F21V 11/00
(52) U.S. Cl. ..... 362/510; 362/290; 362/354
(58) Field of Search ..... 362/510, 511, 290–293, 362/354, 551, 554

(56) References Cited

U.S. PATENT DOCUMENTS 3,455,622 A * 7/1969 Cooper ..... 359/359
3,962,702 A * 6/1976 Kriege ..... 340/815.43

* cited by examiner

*Primary Examiner*—Sandra O'Shea
*Assistant Examiner*—Mark Tsidulko

(57) ABSTRACT

Filtered lights reduce the blinding effect of vehicle headlights on oncoming traffic. A reflector has a bulb socket protruding from its rear and a filter housing attached to its front. A plurality of hollow, opaque tubes are arranged so that light cannot penetrate between them, and their sidewalls are attached to one another and to the sidewall of the filter housing. One end of the tubes, and one end of the filter housing, is attached to a transparent shield. Light beams emitted from a light bulb inserted into the bulb socket are reflected by the reflector through the tubes and shield to focus them on an illuminated area.

7 Claims, 3 Drawing Sheets

FILTERED LIGHT

BACKGROUND OF THE INVENTION

1. Field of the Invention

The present invention relates to a filtered light for use in connection with vehicles. The filtered light has particular utility in connection with reducing the blinding effect of vehicle headlights on oncoming traffic.

2. Description of the Prior Art

Filtered lights are desirable for reducing the blinding effect of vehicle headlights on oncoming traffic. Vehicle headlights, including those applied to automobiles, trucks, and motorcycles, are well known in the prior art. While they perform adequately in illuminating the road ahead for the vehicle's driver, they have the unfortunate side effect of potentially blinding oncoming motorists and drivers in front of the vehicle. As brighter sources of light, such as halogen lights, have come into widespread use, the blinding problem is exacerbated. Filtered lights overcome this problem by limiting the dispersion of the light beam from the illumination source so that oncoming motorists are not blinded.

The use of display systems having a light source separate from a display device is known in the prior art. For example, U.S. Pat. No. 6,428,198 to Saccomanno et al. discloses a display system having a light source separate from a display device. However, the Saccomanno et al. '198 patent does not have a plurality of opaque tubes, and has further drawbacks of requiring a waveguide.

U.S. Pat. No. 5,982,974 to Davis discloses a releasable light adjustment mechanism for a fiberoptic conductor that adjusts light transmitted through it. However, the Davis '974 patent does not have a plurality of opaque tubes, and additionally does not have a plurality of tubes arranged side-by-side.

Similarly, U.S. Pat. No. 6,483,237 to Eastlund et al. discloses a high intensity discharge lamp with single crystal sapphire envelope that generates a light particular useful for image projection. However, the Eastlund et al. '237 patent does not have a plurality of opaque tubes, and does not have a plurality of tubes arranged side-by-side.

In addition, U.S. Pat. No. 5,136,480 to Pristash et al. discloses a thin panel illuminator that emits light along the length of a panel. However can does not have opaque tubes, and also requires a waveguide.

Furthermore, U.S. Pat. No. 5,690,408 to de la Pea et al. discloses a fiber optic based lighting for aircraft that transmits light from a centralized light source to a plurality of light emitters via a plurality of fiber-optic fibers. However, the de la Pea et al. '408 patent does not have a plurality of opaque tubes, and further requires a light emitter.

Lastly, U.S. Pat. No. 5,692,091 to Cassarly et al. discloses compact optical coupling systems that couple non-coherent light from a source of light to a light distribution harness. However, the Cassarly et al. '091 patent does not have a plurality of opaque tubes, and has the additional deficiency of lacking a plurality of tubes arranged side-by-side.

While the above-described devices fulfill their respective, particular objectives and requirements, the aforementioned patents do not describe a filtered light that allows reducing the blinding effect of vehicle headlights on oncoming traffic. The Saccomanno et al. '198 patent, the Davis '974 patent, the Eastlund et al. '237 patent, the Pristash et al. '480 patent, the de la Pea et al. '408 patent, and the Cassarly et al. '091 patent make no provision for a plurality of opaque tubes. The Saccomanno et al. '198 patent and the Pristash et al. '480 patent have further drawbacks of requiring a waveguide. The Davis '974 patent, the Eastlund et al. '237 patent, and the Cassarly et al. '091 patent do not have a plurality of tubes arranged side-by-side. The de la Pea et al. '408 patent has the disadvantages of requiring a light emitter.

Therefore, a need exists for a new and improved filtered light that can be used for reducing the blinding effect of vehicle headlights on oncoming traffic. In this regard, the present invention substantially fulfills this need. In this respect, the filtered light according to the present invention substantially departs from the conventional concepts and designs of the prior art, and in doing so provides an apparatus primarily developed for the purpose of reducing the blinding effect of vehicle headlights on oncoming traffic.

SUMMARY OF THE INVENTION

In view of the foregoing disadvantages inherent in the known types of display systems having a light source separate from a display device now present in the prior art, the present invention provides an improved filtered light, and overcomes the above-mentioned disadvantages and drawbacks of the prior art. As such, the general purpose of the present invention, which will be described subsequently in greater detail, is to provide a new and improved filtered light which has all the advantages of the prior art mentioned heretofore and many novel features that result in a filtered light which is not anticipated, rendered obvious, suggested, or even implied by the prior art, either alone or in any combination thereof.

To attain this, the present invention essentially comprises a reflector with a bulb socket attached to its rear and one end of a filter housing attached to its front. Alight bulb is inserted into the bulb socket, and a plurality of hollow, opaque tubes have their sidewalls attached to one another and to the filter housing's sidewall.

There has thus been outlined, rather broadly, the more important features of the invention in order that the detailed description thereof that follows may be better understood and in order that the present contribution to the art may be better appreciated.

The invention may also include a shield attached to the opposing end of the filter housing. The shield may be transparent or translucent. The shield may be made of plastic or glass. The reflector may be made of metal-coated plastic, steel, aluminum, or a mirror. The sidewalls of the tubes may have a flat black coating applied to them. The sidewalls of the tubes may be arranged so that light cannot pass between the tubes. The tubes may be made of plastic, steel, aluminum, titanium, wood, or carbon fiber composite. The filter housing may be made of plastic, steel, aluminum, titanium, wood, or carbon fiber composite. The reflector may be hemispherical or parabolic in shape. The invention may be a light filter comprising a filter housing with a plurality of hollow, opaque tubes having their sidewalls attached to one another and to the filter housing's sidewall. The filter housing may be ring-shaped. There may be a shield attached to one of the opposing ends of the filter housing. The filter housing may be adapted to fit a standard automobile headlight. The invention may be an improvement to a headlight. There are, of course, additional features of the invention that will be described hereinafter and which will form the subject matter of the claims attached.

Numerous objects, features, and advantages of the present invention will be readily apparent to those of ordinary skill in the art upon a reading of the following detailed description of presently current, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved filtered light that has all of the advantages of the prior art display systems having a light source separate from a display device and none of the disadvantages.

It is another object of the present invention to provide a new and improved filtered light that may be easily and efficiently manufactured and marketed.

An even further object of the present invention is to provide a new and improved filtered light that has a low cost of manufacture with regard to both materials and labor, and which accordingly is then susceptible of low prices of sale to the consuming public, thereby making such filtered light economically available to the buying public.

Still another object of the present invention is to provide a new filtered light that provides in the apparatuses and methods of the prior art some of the advantages thereof, while simultaneously overcoming some of the disadvantages normally associated therewith.

Even still another object of the present invention is to provide a filtered light for reducing the blinding effect of vehicle headlights on oncoming traffic. This allows the light filter to be attached to an existing automobile headlight.

Still yet another object of the present invention is to provide a filtered light for reducing the blinding effect of vehicle headlights on oncoming traffic. This makes it possible to limit the dispersion of a light beam from a light source.

An additional object of the present invention is to provide a filtered light for reducing the blinding effect of vehicle headlights on oncoming traffic. This maximizes illumination in the lane where the motorist is traveling while minimizing illumination of the oncoming traffic lane.

A further object of the present invention is to provide a filtered light for reducing the blinding effect of vehicle headlights on oncoming traffic. This controls the beam width of vehicle headlights to prevent blinding oncoming motorists.

Lastly, it is an object of the present invention to provide a new and improved filtered light for reducing the blinding effect of vehicle headlights on oncoming traffic.

These together with other objects of the invention, along with the various features of novelty that characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there is illustrated current embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE CURRENT EMBODIMENT

Figure 1:
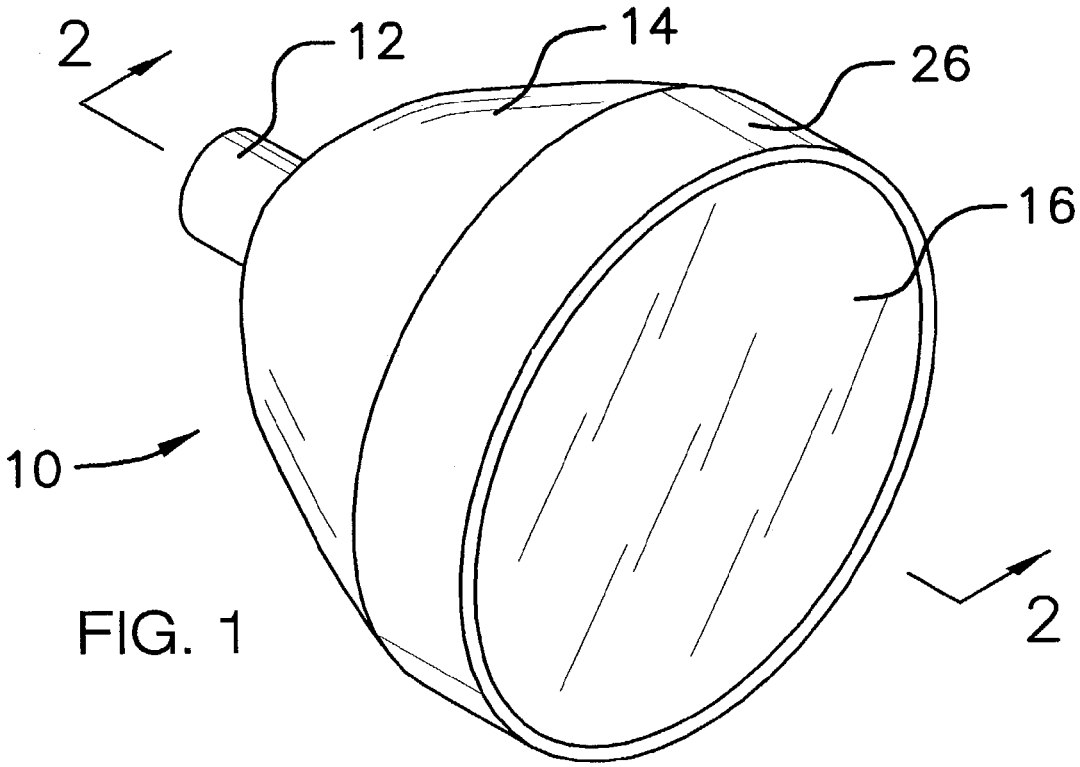
FIG. 1 is a top perspective view of the current embodiment of the filtered light constructed in accordance with the principles of the present invention.

Referring now to the drawings, and particularly to FIGS. 1–5, a current embodiment of the filtered light of the present invention is shown and generally designated by the reference numeral 10.

In FIG. 1, a new and improved filtered light 10 of the present invention for reducing the blinding effect of vehicle headlights on oncoming traffic is illustrated and will be described. More particularly, the filtered light 10 has a reflector 14 with a filter housing 26 attached to its front and a bulb socket 12 protruding from its rear. A shield-16 is attached to one end of filter housing 26. In the current embodiment, shield 16 is transparent and made of plastic and filter housing 26 is ring-shaped. Reflector 14 is made of metal-coated plastic and filter housing 26 is made of plastic in the current embodiment.

Figure 2:
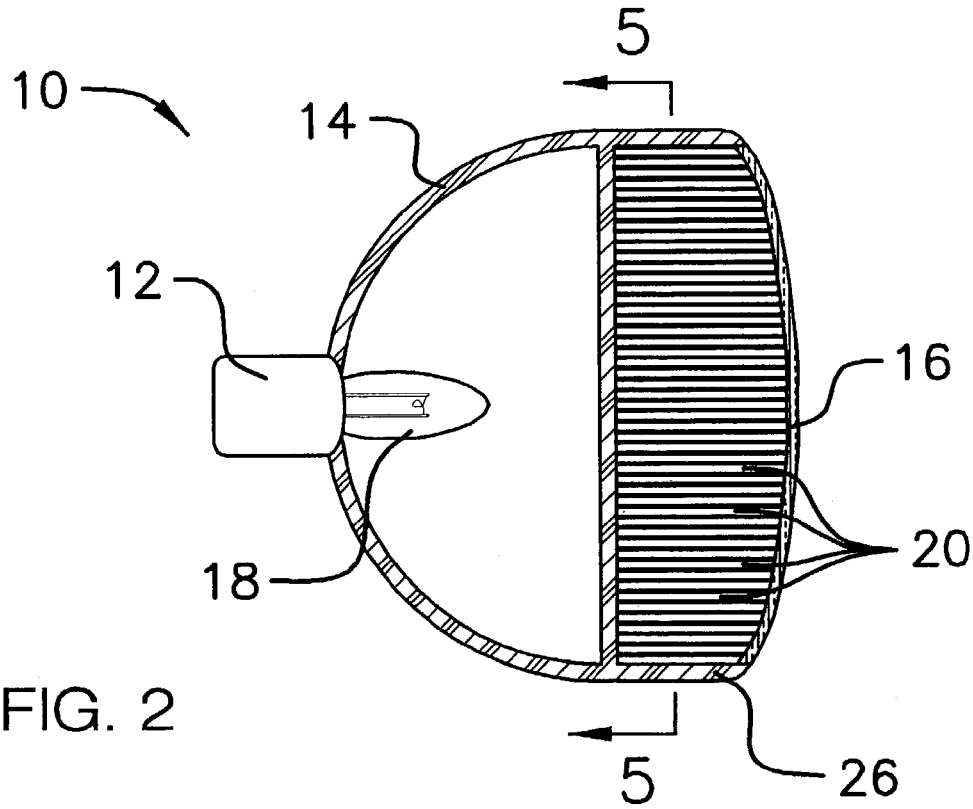
FIG. 2 is a side sectional view of the filtered light of the present invention.

Moving on to FIG. 2, a new and improved filtered light 10 of the present invention for reducing the blinding effect of vehicle headlights on oncoming traffic is illustrated and will be described. More particularly, the filtered light 10 has a plurality of tubes 20 arranged side-by-side with one end attached to shield 16. The sidewalls of tubes 20 are arranged so that light cannot penetrate between them, and the sidewalls of the tubes adjacent to the sidewall of the filter housing 26 are attached to the sidewall of the filter housing 26. A light bulb 18 is shown with one end inserted into bulb socket 12. At least the inner surface of reflector 14 is reflective and reflects light beams 22 (not shown) emitted from light bulb 18 into tubes 20. Light beams 22 then pass through tubes 20 and shield 16 to create an illuminator area 24 (not shown). In the current embodiment, tubes 20 are made of plastic and are rendered opaque by a flat black coating applied to their sidewalls. Reflector 14 is hemispherical in shape in the current embodiment. The shield 16 protects the tubes 20 from damage.

Figure 3:
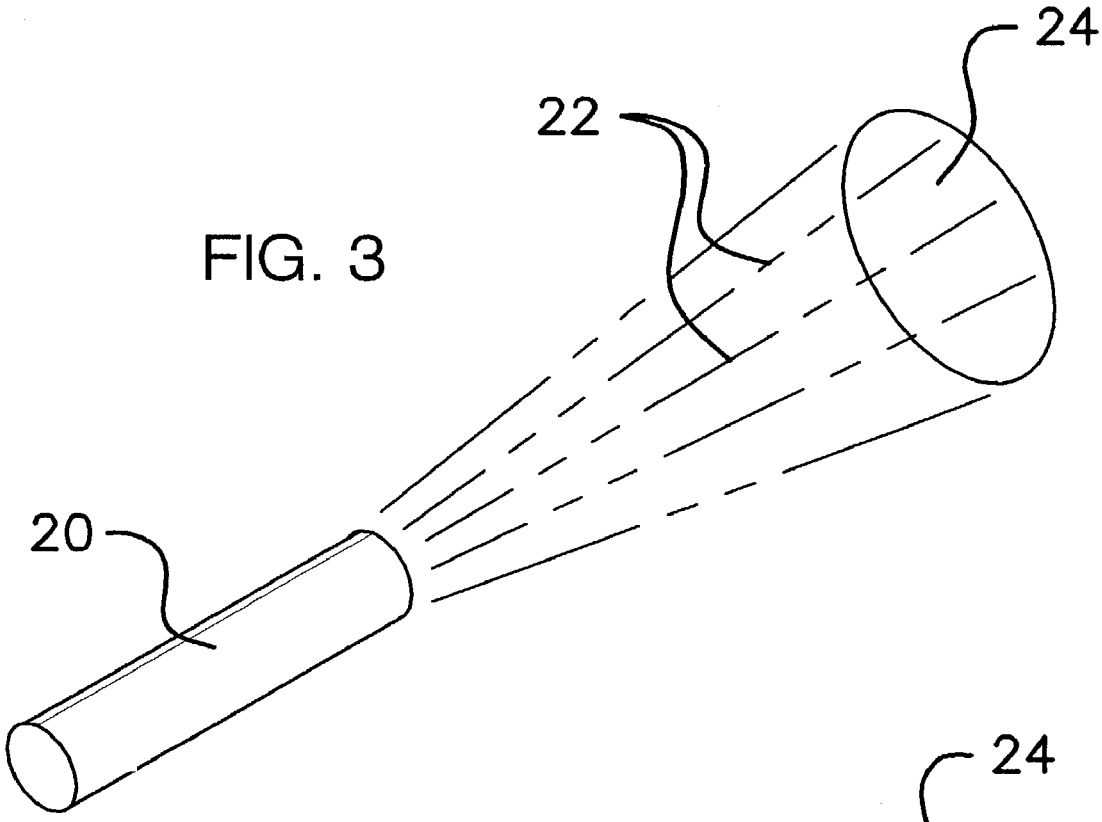
FIG. 3 is a top perspective view of the tube of the present invention.

Continuing with FIG. 3, a new and improved tube 20 of the present invention for reducing the blinding effect of vehicle headlights on oncoming traffic is illustrated and will be described. More particularly, the tube 20 is hollow and has an opaque sidewall. Light beams 22 passing through tube 20 are focused onto an illuminated area 24. In this example, tube 20 has a relatively short length and a large diameter, resulting in a larger illuminated area 24.

Figure 4:
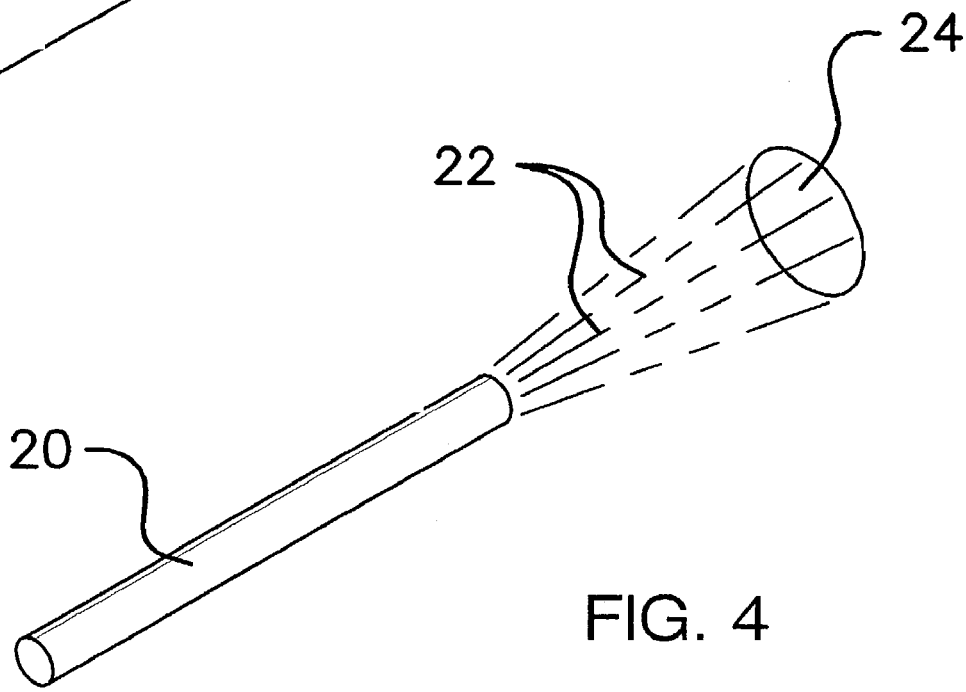
FIG. 4 is a top perspective view of the tube of the present invention.

In FIG. 4, a new and improved tube 20 of the present invention for reducing the blinding effect of vehicle headlights on oncoming traffic is illustrated and will be described. More particularly, the tube 20 is hollow with an opaque sidewall. Light beams 22 passing through tube 20 are focused onto an illuminated area 24. In this example, tube 20 has a relatively long length and a small diameter, resulting in a smaller illuminated area 24.

Figure 5:
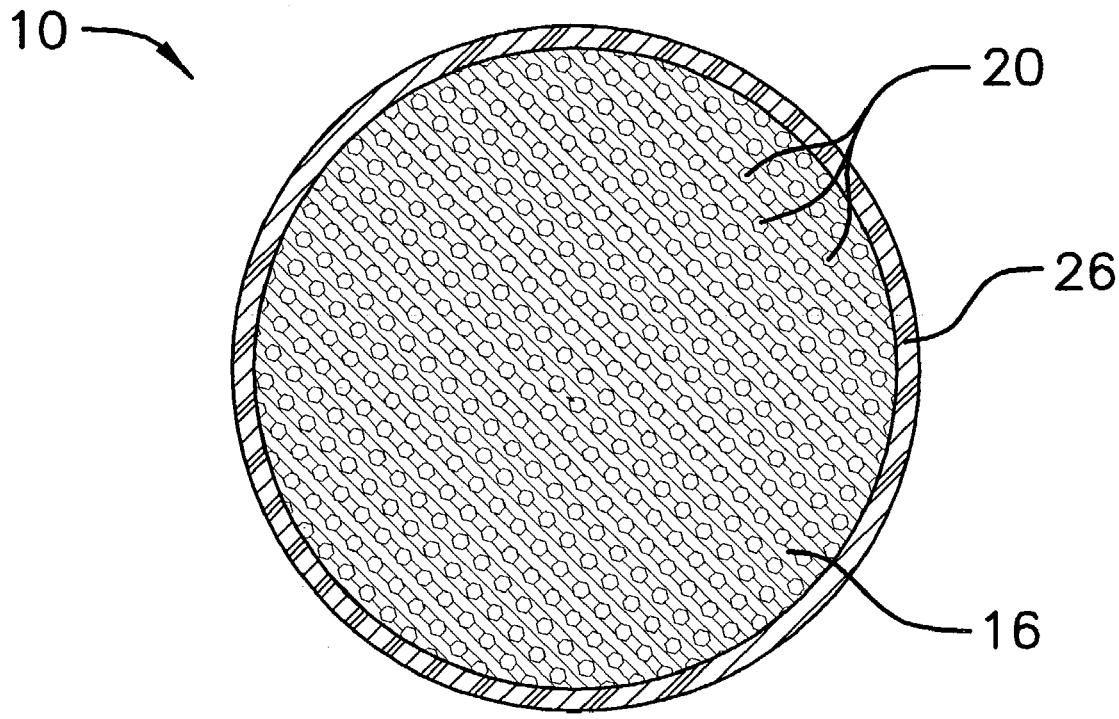
FIG. 5 is a front side sectional view of the filtered light of the present invention.

Concluding with FIG. 5, a new and improved filtered light 10 of the present invention for reducing the blinding effect of vehicle headlights on oncoming traffic is illustrated and will be described. More particularly, the filtered light 10 has a plurality of tubes 20 arranged side-by-side so that light beams 22 cannot pass between them. The sidewalls of the outermost tubes 20 are attached to the sidewall of filter housing 26, and shield 16 is attached to one end of filter housing 26.

In use, it can now be understood that the size and pattern of the illuminated area 24 is determined by the length and diameter of the tubes 20 employed in the filtered light 10. The filtered light 10 can be used as an automobile headlight, or the filter housing 26, shield 16, and tubes 20 portion of the filtered light 10 can be applied to an existing automobile headlight. Light beams 22 generated by light bulb 18 are reflected by the interior of reflector 14 into one end of tubes 20. Because tubes 20 are opaque and have been arranged so that light beams 22 cannot pass between them, all of the light beams 22 must pass completely through tubes 20 in order to be emitted from the filtered light 10. As the light beams 22 pass through tubes 20, they are focused onto an illuminated area 24. The transparent nature of shield 16 allows light beams 22 to pass through it unaffected.

While a current embodiment of the filtered light has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable reflective material such as steel, aluminum, or a mirror may be used instead of the metal-coated plastic reflector described. Also, the plastic filter housing may also be made of steel, aluminum, titanium, wood, or carbon fiber composite. And although reducing the blinding effect of vehicle headlights on oncoming traffic has been described, it should be appreciated that the filter housing, shield, and tubes portion of the filtered light herein described is also suitable for filtering any light source. Furthermore, a wide variety of tube quantities, lengths, and diameters may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A filtered light comprising:

a reflector having a front and a rear;

a bulb socket attached to said rear of said reflector;

a light bulb having opposing ends with one end inserted into said bulb socket;

a filter housing having opposing ends and a sidewall with one end attached to said front of said reflector;

a plurality of hollow, opaque tubes having a sidewall with said sidewalls attached to one another and to said sidewall of said filter housing; and shield attached to said opposing end of said filter housing.

2. The filtered light as defined in claim 1, wherein said shield is transparent or translucent.

3. The filtered light as defined in claim 1, wherein said shield is selected from the group consisting of plastic and glass.

4. A light filter comprising:

a filter housing having a sidewall and opposing ends;

a plurality of hollow, opaque tubes having a sidewall with said sidewalls attached to one another and to said sidewall of said filter housing; and shield attached to one of said opposing ends of said filter housing.

5. The light filter as defined in claim 4, wherein said shield is transparent or translucent.

6. A light filter comprising:

a filter housing having a sidewall and opposing ends; and a plurality of hollow, opaque tubes having a sidewall with said sidewalls attached to one another and to said sidewall of said filter housing;

wherein said filter housing is adapted to fit a standard automobile headlight.

7. In combination with a headlight, including a reflector having a front, the improvement which comprises:

a filter housing having opposing ends and a sidewall with one end attached to said front of said reflector;

a plurality of hollow, opaque tubes having a sidewall with said sidewalls attached to one another and to said sidewall of said filter housing; and shield attached to said opposing end of said filter housing.

* * * * *